United States Patent [19]

Galli

[11] 4,253,429

[45] Mar. 3, 1981

[54] PISTON FOR INTERNAL COMBUSTION ENGINES

[75] Inventor: Ercole Galli, Turin, Italy

[73] Assignee: Mondial Piston Dr. Galli Ercole & C.S.p.A., Turin, Italy

[21] Appl. No.: 22,137

[22] Filed: Mar. 20, 1979

[30] Foreign Application Priority Data

Mar. 22, 1978 [IT] Italy ..... 67626 A/78

[51] Int. Cl.[3] ..... F01P 1/04; F01P 3/06

[52] U.S. Cl. ..... 123/41.35; 123/193 P

[58] Field of Search ..... 123/193 P, 41.34, 41.35, 123/41.39

[56] References Cited

U.S. PATENT DOCUMENTS

| | | | |
|---|---|---|---|
| 3,215,130 | 11/1965 | Maier | 123/41.35 |
| 3,613,521 | 10/1971 | Itano | 123/41.35 |

FOREIGN PATENT DOCUMENTS

| | | | |
|---|---|---|---|
| 80348 | 4/1951 | Czechoslovakia | 123/41.35 |
| 1055879 | 4/1959 | Fed. Rep. of Germany | 123/41.35 |
| 2140824 | 2/1973 | Fed. Rep. of Germany | 123/41.35 |

*Primary Examiner*—Craig R. Feinberg

*Attorney, Agent, or Firm*—Sughrue, Rothwell, Mion, Zinn & Macpeak

[57] ABSTRACT

A piston for internal combustion engines, of the type having a crown portion and a cylindrical skirt portion in the latter of which are formed thickened portions called bosses having holes for receiving the ends of a gudgeon pin by which the piston is attached to a connecting rod, in which provision is made for avoiding thermal stresses and possible consequent damage due to the variations in wall thickness in the region of the bosses by forming therein two interior chambers each communicating with the interior of the piston and with the respective hole for receiving an end of the gudgeon pin via ducts through which the engine lubricating oil flows as a coolant when the engine is running.

3 Claims, 4 Drawing Figures

PISTON FOR INTERNAL COMBUSTION ENGINES

BACKGROUND OF THE INVENTION

The present invention relates to pistons for internal combustion engines, particularly pistons made of light alloy, of the type including a cylindrical skirt the wall thickness of which, is of increased thickness at two diametrically opposite points to form the so-called "bosses" each of which has a hole extending radially with respect to the cylindrical piston skirt. The two holes are axially aligned with one another and are intended to receive and support the end of a gudgeon pin by means of which the piston is attached to one end, the so called little end, of a connecting rod, the other end, the so-called big end, of which is journalled on the crankshaft.

Pistons of the above described type are particularly susceptible to damage due to stresses to which they are subject because of the elevated temperatures which are attained within the cylinders when the engine is running. These stresses are due above all to the relatively large differences between the temperatures which are reached by the different parts of the piston wall when the engine is running. In particular the two above mentioned zones of thickened skirt wall (the so-called "bosses") reach mush higher temperatures than the adjacent parts of the skirt of the piston, due to the greater mass of these bosses.

Normally, in order to encourage the cooling of the interior cavity of the piston, defined by the piston skirt, and in particular to encourage the cooling of the bosses, the oil which serves for the lubrication of the engine is used as a coolant; this is achieved by allowing a part of the lubrication oil to escape from the associated crank of the crankshaft of the engine, this oil being thrown by centrifugal force against the inside wall of the piston skirt.

This cooling system, however, does not give satisfactory results from the point of view of the reduction of the sharp temperature differences which give rise to the above mentioned heat originated stresses.

OBJECTS OF THE INVENTION

The primary object of the present invention is to provide a piston for an internal combustion engine, in which thermal stresses can be reduced by a more efficacious cooling effect obtained in the regions of greater wall thickness which have a greater concentration of mass than the immediately adjacent regions.

Another object of the invention is to achieve the above object without recourse to complex structural forms for said piston.

A further object of the invention is to provide a piston in which improved cooling can be obtained without reducing the structural strength of the piston itself.

SUMMARY OF THE INVENTION

With a view to achieving the above mentioned object the present invention provides a piston for an internal combustion engine, said piston having a crown portion and a cylindrical skirt portion, two wall regions of said cylindrical skirt portion being of increased wall thickness with respect to the remainder of said cylindrical skirt to form diametrically opposed bosses, means defining respective radial holes in said bosses, said radial holes being axially aligned with one another for receiving and supporting respective ends of a gudgeon pin, means defining an inner chamber in each said boss, said inner chambers being located in that part of said bosses between said radial holes and said crown of said piston, and means defining first and second ducts within said cylindrical skirt portions of said piston, said first ducts communicating between said inner chambers and said radial holes for said gudgeon pin, said second ducts communicating between said inner chambers and said interior cavity of said pistons.

The inner chambers with which each of the two bosses of the piston is provided allow a more efficacious cooling to be obtained in the said regions of greater wall thickness constituting the bosses, without however causing a dangerous reduction in the cross sectional thickness of the piston or in its structural strength. In addition the improved cooling effect is obtained without further complicating the shape of the piston by more than a minimum miniman extent. The lubrication oil of the engine, which is thrown by centrifugal force against the inner wall of the skirt of the piston, can in fact flow, via the said ducts, into the inner chambers within the two bosses, thereby assisting the cooling thereof from the inside of the bosses, in the region which would otherwise be the hottest, so that the temperature differences from one point to another are reduced.

The said two inner chambers within the bosses, and the said ducts which put these chambers in communication with the holes for the gudgeon pin and with the interior cavity of the piston can conveniently be formed when the piston is being cast by means of soluble cores.

Other characteristics and advantages of the invention will become apparent from a study of the following description in which reference is made to the accompanying drawings, provided purely by way of non-limitative example.

DESCRIPTION OF THE PREFERRED EMBODIMENT

Figure 1:
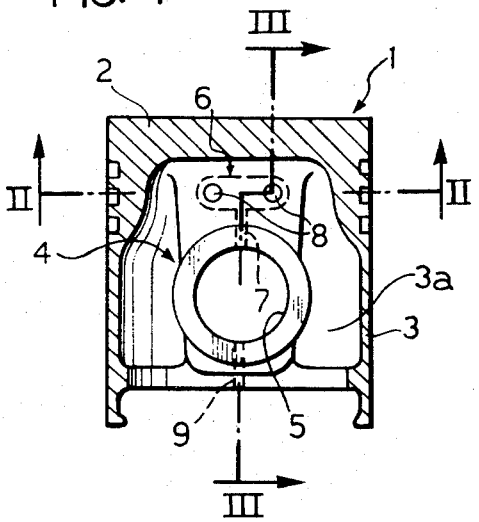
FIG. 1 is a sectional view of the novel piston of this invention, taken on the line I—I of FIG. 2.
Figure 2:
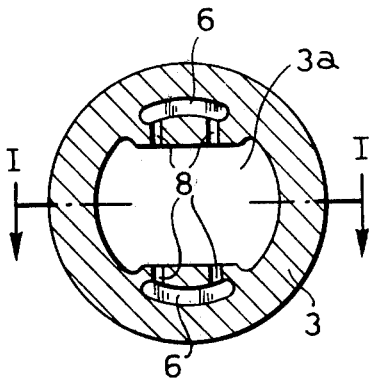
FIG. 2 is a sectional view of the novel piston taken on the line II—II of FIG. 1.

In the drawings there is shown a piston 1 for an internal combustion engine, comprising a crown 2 and a cylindrical skirt 3 surrounding an interior cavity 3*a*. The piston skirt 3 has portions of enlarged wall thickness constituting two opposite bosses 4 in each of which is formed a respective radial hole 5 for receiving a respective end of a gudgeon pin. The two radial holes 5 are thus axially aligned with one another.

Each of the bosses 4 extends up to the piston crown 2 and is provided, in the portion thereof lying between the hole 5 therein and the piston crown 2, with an inner chamber 6 communicating with the radial hole 5 by means of a duct 7 which extends substantially axially with respect to the cylindrical skirt 3. Each of the inner chambers 6 also communicates with the interior cavity 3*a* of the piston 1 by means of two substantially radial ducts 8. The inner surface of each hole 5 can be provided at the mouth of the respective duct 7 with grooves for the distribution of the oil.

Figure 3:
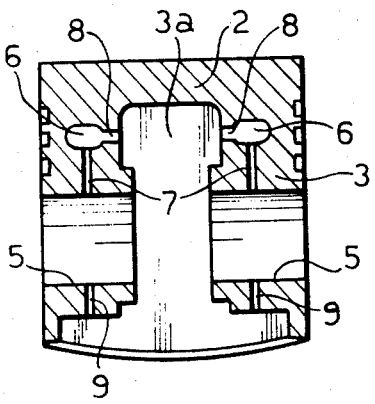
FIG. 3 is a sectional view of the novel piston taken on the line III—III of FIG. 1.

Each of the bosses 4 of the skirt 3 can also be provided, if desired or necessary, with an axial duct 9, as shown in FIG. 3, extending away from the hole 5 on the side thereof opposite the duct 7. This duct 9 puts the hole 5 into direct communication with the interior cavity 3*a* of the pistons; the ducts 9 operate in the manner of a nozzle to feed the lubrication oil into the space between the gudgeon pin and the holes 5 in which it is borne.

Figure 4:
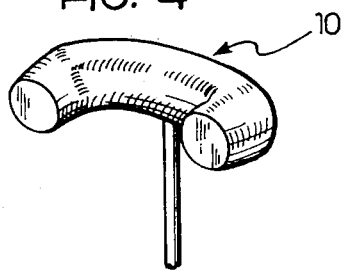
FIG. 4 illustrates a water soluble core suitable for use in the manufacture of the novel piston according to the present invention.

Each of the inner chambers 6 and the associated ducts 7, 8, can be formed by employing a water soluble core. In FIG. 4 there is shown, purely by way of example, a suitable shape for such a core 10 adapted for this purpose.

The lubrication oil of the engine, which escapes from the crank of the crankshaft and is thrown by centrifugal force against the inner wall of the piston skirt, can reach each of the inner chambers 6 either by flowing directly through the ducts 8 and then draining through the ducts 7 into the spaces between the holes 5 and the outer surface of the gudgeon pin, or alternatively, if the oil is forced up the duct 9 it will flow first into the space between the walls of each hole 5 and the outer surface of the gudgeon pin, subsequently rising, by the pumping effect, through the ducts 7 into the inner chambers 6.

The lubrication oil within each inner chamber 6 assists the cooling of the associated boss 4 and also avoids the creation of sharp temperature differences within the body of the piston, which could cause associated thermal stressing.

Naturally, the principle of the present invention can be employed in modifications of and variations to the embodiment described above by way of example, such as could be made by those skilled in the art armed with the teaching of the present invention, without thereby departing from the scope of the invention as defined in the following claims.

What is claimed is:

1. A piston for an internal combustion engine, said piston having a crown portion and a cylindrical skirt portion, formed in one piece with the crown portion, two wall regions of said cylindrical skirt portion being of increased wall thickness with respect to the remainder of said cylindrical skirt to form diametrically opposed bosses, means defining respective radial holes in said bosses, said radial holes being axially aligned with one another for receiving and supporting respective ends of a gudgeon pin, means defining an inner chamber in each said boss, said inner chambers being located completely within said bosses in that part of said bosses between said radial hole and said crown of said piston, and having central portions of said inner chambers disposed on a diameter of said piston perpendicular to the axis of the piston and parallel to the axis of said holes, means defining first and second ducts within said cylindrical skirt portion of said piston, said first ducts communicating between said inner chamber and said radial holes for said gudgeon pin, and said second ducts communicating between said inner chambers and said interior cavity of said piston.

2. The piston of claim 1, wherein said first ducts which communicate between said inner chambers and said radial holes for said gudgeon pin are directed substantially axially of said cylindrical skirt portion of said piston.

3. The piston of claim 1, wherein said second ducts which communicate between said inner chambers and said interior cavity of said piston extend substantially radially with respect to said cylindrical skirt portion of said piston.

* * * * *